US005826908A

United States Patent [19]

McBride

[11] Patent Number: 5,826,908

[45] Date of Patent: Oct. 27, 1998

[54] SNOWBOARD MOUNTING APPARATUS

[76] Inventor: Anthony R. L. McBride, 18456 65th Avenue, Surrey, British Columbia, Canada, V3S 8T1

[21] Appl. No.: 888,228

[22] Filed: Jul. 3, 1997

[51] Int. Cl.[6] ..... A63C 11/14

[52] U.S. Cl. ..... 280/814; 211/70.5; 280/809; 280/815

[58] Field of Search ..... 280/809, 815, 280/814; 211/70.5

[56] References Cited

U.S. PATENT DOCUMENTS 2,328,069 8/1943 Kurtz ..... 280/815

4,231,501 11/1980 Goode ..... 211/70.5

4,976,577 12/1990 Brown et al. ..... 411/271

FOREIGN PATENT DOCUMENTS 3637002 5/1988 Germany ..... 280/814

*Primary Examiner*—D. Glenn Dayoan
*Assistant Examiner*—Clovia Hamilton
*Attorney, Agent, or Firm*—Douglas E. MacKenzie

[57] ABSTRACT

A Snowboard Mounting Apparatus for safely storing and displaying a snowboard or similar article on a wall or other supporting surface. The inventive device includes a jaw for clamping the snowboard or similar article and a mounting plate for mounting the jaw to the wall or other supporting surface.

6 Claims, 3 Drawing Sheets

SNOWBOARD MOUNTING APPARATUS

BACKGROUND OF THE INVENTION

1. Field of the Invention

The present invention relates to article supporting apparatus and more particularly pertains to a new Snowboard Mounting Apparatus for safely storing and displaying a snowboard or similar article on a wall or other supporting surface.

2. Description of the Prior Art

The use of article supporting apparatus is known in the prior art. More specifically, article supporting apparatus heretofore devised and utilized are known to consist basically of familiar, expected and obvious structural configurations notwithstanding the myriad of designs encompassed by the crowded prior art which have been developed for the fulfillment of countless objectives and requirements.

Known prior art article supporting apparatus include U.S. Pat. No. 5,390,839; U.S. Pat. No. 4,798,298; U.S. Pat. No. 4,763,797; U.S. Pat. No. 4,007,554; and U.S. Pat. No. Des. 332,594.

While these devices fulfill their respective, particular objectives and requirements, the aforementioned patents do not disclose a new Snowboard Mounting Apparatus. The inventive device includes a means for clamping the snowboard or similar article and a means for mounting the means for clamping the snowboard or similar article to the supporting surface.

In these respects, the Snowboard Mounting Apparatus according to the present invention substantially departs from the conventional concepts and designs of the prior art, and in so doing provides an apparatus primarily developed for the purpose of safely storing and displaying a snowboard or similar article on a wall or other supporting surface.

SUMMARY OF THE INVENTION

In view of the foregoing disadvantages inherent in the known types of article supporting apparatus now present in the prior art, the present invention provides a new Snowboard Mounting Apparatus construction wherein the same can be utilized for safely storing and displaying a snowboard or similar article on a wall or other supporting surface.

The general purpose of the present invention, which will be described subsequently in greater detail, is to provide a new Snowboard Mounting Apparatus apparatus and method which has many of the advantages of the article supporting apparatus mentioned heretofore and many novel features that result in a new Snowboard Mounting Apparatus which is not anticipated, rendered obvious, suggested, or even implied by any of the prior art article supporting apparatus, either alone or in any combination thereof.

To attain this, the present invention generally comprises a means for clamping the snowboard or similar article and a means for mounting the means for clamping the snowboard or similar article to the supporting surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Snowboard Mounting Apparatus apparatus and method which has many of the advantages of the article supporting apparatus mentioned heretofore and many novel features that result in a new Snowboard Mountings Apparatus which is not anticipated, rendered obvious, suggested, or even implied by any of the prior art article supporting apparatus, either alone or in any combination thereof.

It is another object of the present invention to provide a new Snowboard Mounting Apparatus which may be easily and efficiently manufactured and marketed.

It is a further object of the present invention to provide a new Snowboard Mounting Apparatus which is of a durable and reliable construction.

An even further object of the present invention is to provide a new Snowboard Mounting Apparatus which is susceptible of a low cost of manufacture with regard to both materials and labor, and which accordingly is then susceptible of low prices of sale to the consuming public, thereby making such Snowboard Mounting Apparatus economically available to the buying public.

Still yet another object of the present invention is to provide a new Snowboard Mounting Apparatus which provides in the apparatuses and methods of the prior art some of the advantages thereof, while simultaneously overcoming some of the disadvantages normally associated therewith.

Still another object of the present invention is to provide a new Snowboard Mounting Apparatus for safely storing and displaying a snowboard or similar article on a wall or other supporting surface.

Yet another object of the present invention is to provide a new Snowboard Mounting Apparatus which includes a means for clamping the snowboard or similar article and a means for mounting the means for clamping the snowboard or similar article to the supporting surface.

Still yet another object of the present invention is to provide a new Snowboard Mounting Apparatus that allows for mounting a snowboard or similar article in a plurality of space-saving, angled positions.

Yet another object of the present invention is to provide a new Snowboard Mounting Apparatus which enables one to mount the snowboard in such manner that the decorative features thereof are displayed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
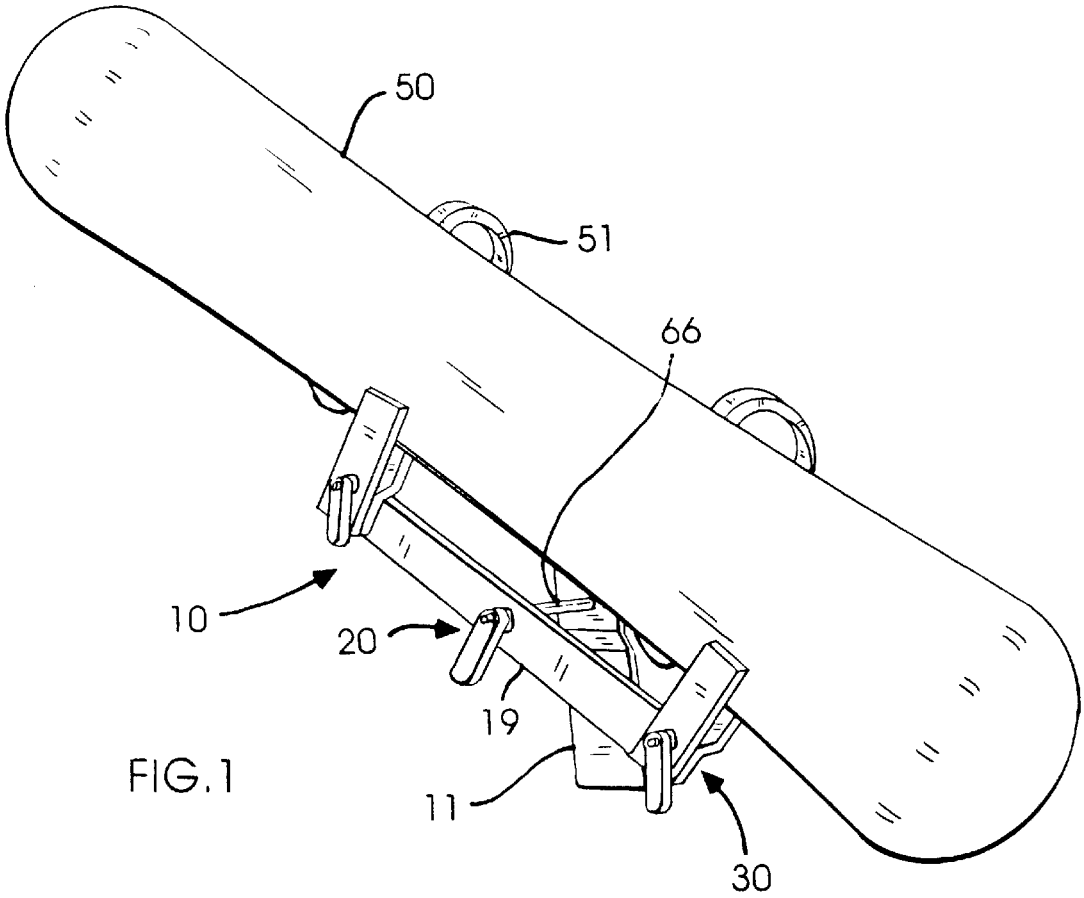
FIG. 1 is a right side perspective view of a new Snowboard Mounting Apparatus according to the present invention.
Figure 2:
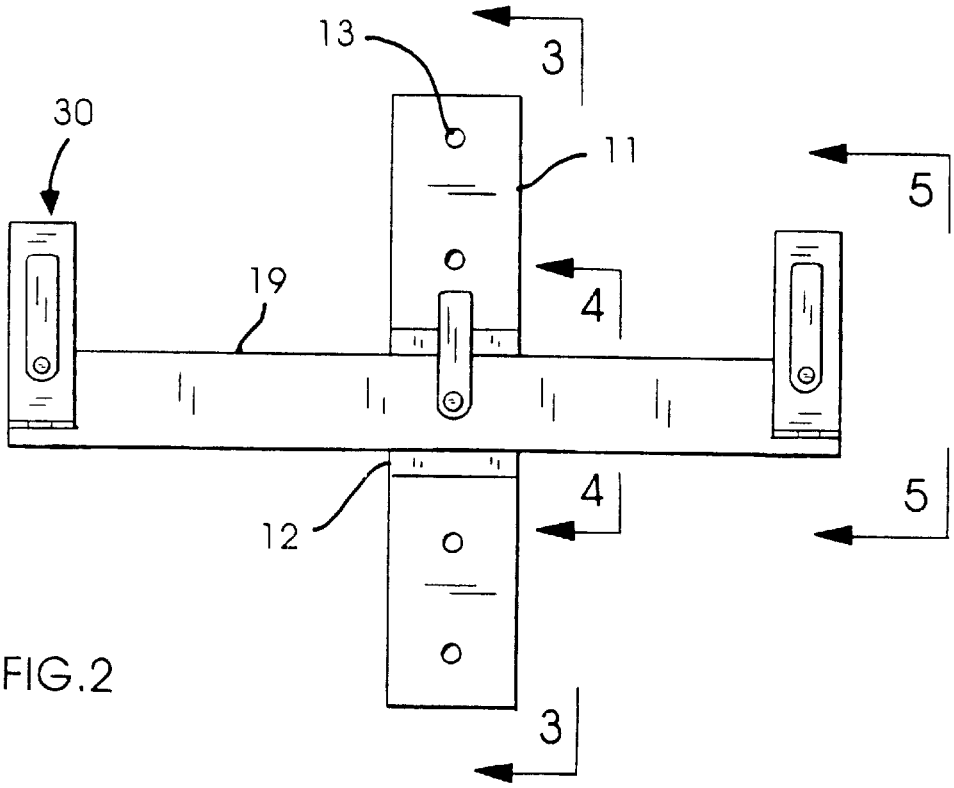
FIG. 2 is a top plan view thereof.

With reference now to the drawings, and in particular to FIGS. 1 through 6 thereof, a new Snowboard Mounting Apparatus embodying the principles and concepts of the present invention and generally designated by the reference numeral 10 will be described.

More specifically, it will be noted that the Snowboard Mounting Apparatus 10 comprises a means for clamping the snowboard or similar article including a jaw 30 and a means for mounting the jaw 30 to the supporting surface including a mounting plate 11 attachable to the supporting surface and a shaft 66 having a threaded first end 14 and a threaded second end 16, the threaded first end 14 being threadingly attachable to the mounting plate 11 and the threaded second end 16 being threadingly attachable to a mounting frame 19 to which is fixedly attached the jaw 30.

With reference to FIG. 1 there is shown a snowboard 50 having straps 51 mounted in the Snowboard Mounting Apparatus 10. The mounting plate 11 is attached to a supporting surface such as a wall (not shown). The shaft 66 is shown extending from the mounting plate 11, away from the supporting surface, to provide clearance for the snowboard 50. The shaft is preferably 8 inches long and ⅝ of an inch in diameter. The snowboard 50 is shown clamped by means of jaws 30. A mounting frame positioning means 20 is shown for securing the orientation of the mounting frame 19.

Figure 3:
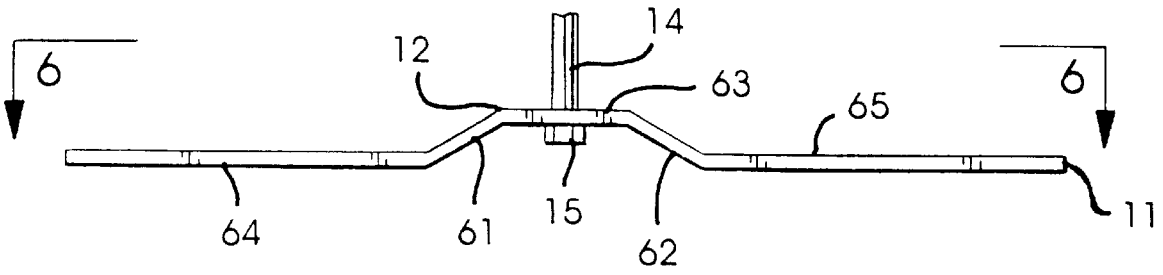
FIG. 3 is a side view of the mounting plate of the present invention.
Figure 6:
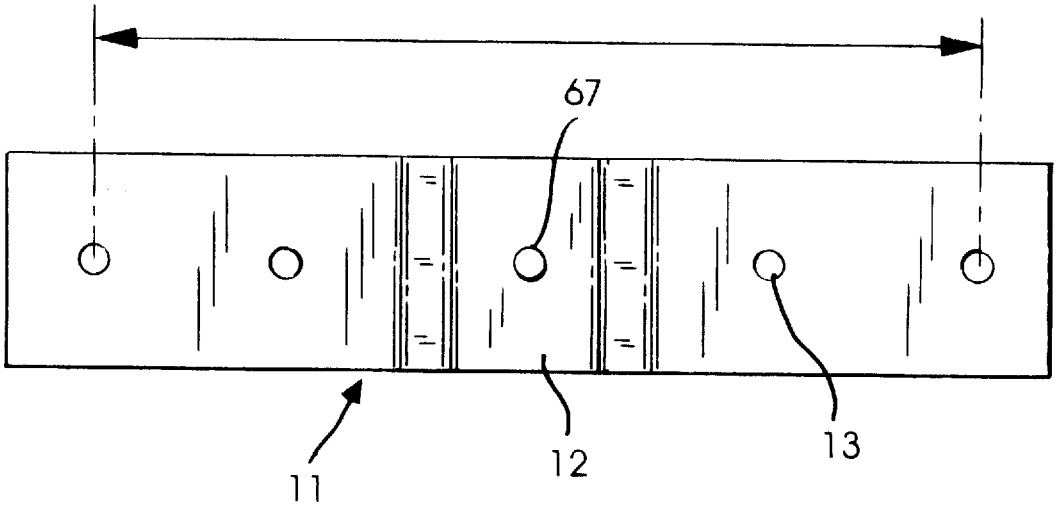
FIG. 6 is a top plan view of the mounting plate.

With reference to FIGS. 3 and 6 there is shown the mounting plate 11 including a raised section 12 having a threaded bore 67 formed therein. The mounting plate is fabricated of steel or aluminum alloy and preferably is 20 inches long by 4 inches wide by ¼ inch thick. A plurality of bores 13 are shown for receiving a plurality of screws for securing the mounting plate to the supporting surface. The raised section 12 consists of a flat section 63 disposed intermediate a first lateral section 61 and a second lateral section 62. The raised section 12 is shown extending from a wall facing surface 64 toward an outward facing surface 65. The flat section 63 is preferably 4 inches in length and extends one inch from the supporting surface.

With particular reference to FIG. 3 the shaft threaded first end 14 is shown threadingly disposed in the threaded bore 67 and secured thereon by locking nut 15.

Figure 4:
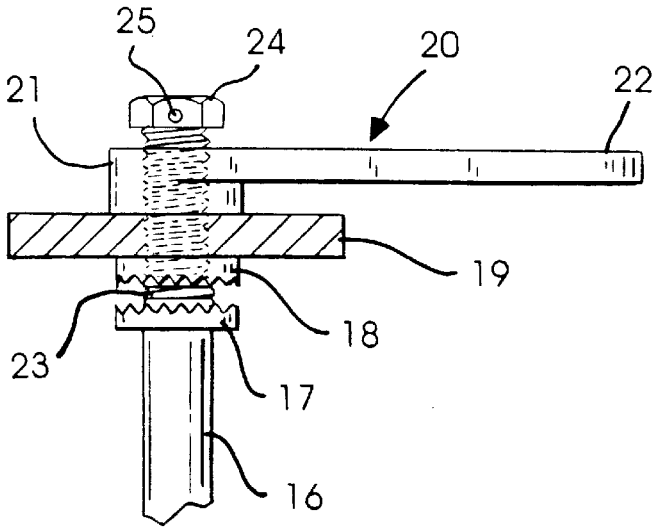
FIG. 4 is a partial cross sectional view of the mounting frame positioning means of the invention.

With reference to FIG. 4 there is shown the mounting frame positioning means 20 of the present invention. A first positioning plate 17 having a plurality of teeth formed on one surface is shown fixedly attached to the threaded second end 16. A second positioning plate 18 having a plurality of teeth formed on a surface such that the teeth formed on the first positioning plate 17 intermesh with the teeth formed on the second positioning plate 18 is shown fixedly attached to the mounting frame 19, which is preferably 24 inches long by 2 inches wide by ¼ inch thick. Shown disposed between the first positioning plate 17 and the second positioning plate 18 is a helical spring 23 for biasing the second positioning plate 18 away from the first positioning plate 17. A shaft nut 21 is shown threadingly engaged to the threaded second end 16 for securing the mounting frame 19 in a selected position determined by the intermeshing of the teeth formed on the first and second positioning plates 17 and 18.

The shaft nut 21 is shown including in a first arm 22 for providing a means for easily hand tightening the shaft nut 21 to the mounting frame 19. A position retaining nut 24 is shown having a set screw 25 disposed therein, the position retaining nut 24 serving to retain the shaft nut in position and the set screw 25 serving to retain the position retaining nut 24 is position.

Figure 5:
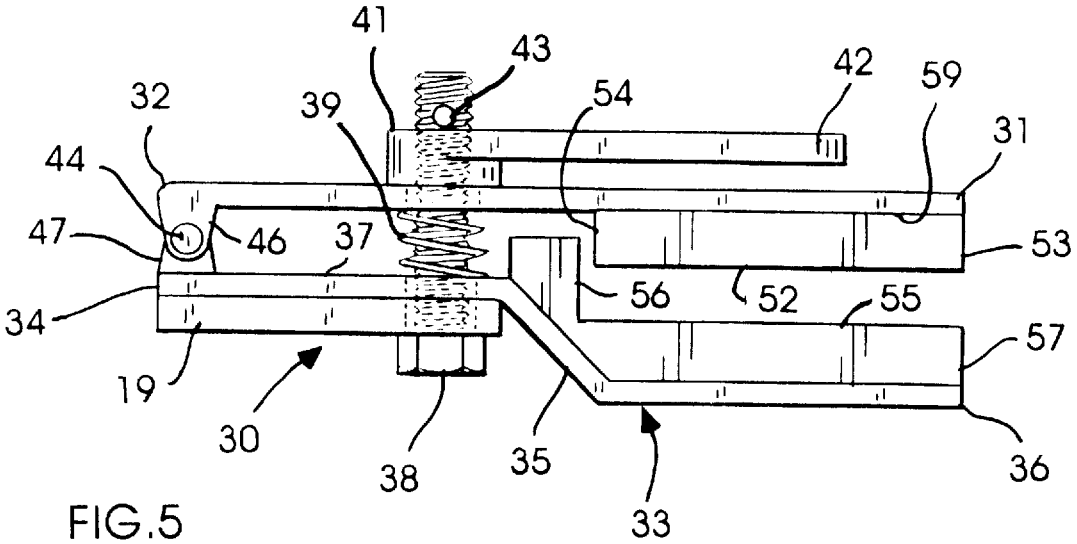
FIG. 5 is a partial cross sectional of the clamping means of the present invention.

With reference to FIG. 5 there is shown the means for clamping the snowboard or similar article including a jaw 30 having a lower portion 33 fixedly attached, as by welding, to the mounting frame 19 along a lower portion frame section 37. The jaw 30 further comprises a means for hingedly attaching the lower portion 33 to an upper portion 31 including a pin 44 receivable through apertures formed in a first extension 46 disposed at an upper portion hinge end 32 and a second extension 47 disposed at a lower portion hinge end 34. In this manner the upper portion 31 is allowed to rotate relative to the lower portion 33.

With continued reference to FIG. 5 a spring 39 is shown disposed around a bolt 38 and between the lower portion 33 and the upper portion 31. The bolt 38 is shown extending perpendicularly relative to the mounting frame 19, lower portion frame section 37 and upper portion 31 through a plurality of apertures formed therein. The bolt 38 further includes a bolt threaded end 49 for threadingly engaging a nut 41 having a second arm 42 for providing a means for easily hand tightening the nut 41 to the upper portion 31. A lock aperture 43 is shown for receiving a padlock.

With continued reference to FIG. 5 the lower portion 33 further includes an angled section 35 and a clamping section 36. The angled section 35 is shown intermediate the lower portion frame section 37 and the clamping section 36 and extends downwardly from the lower portion frame section 37 relative to the upper portion 31 and terminates at the clamping section 36. The clamping section 36 is shown having a plane parallel to a plane of the lower portion frame section 37.

A first rubber pad 55 is shown fixedly attached to a clamping section inner surface 58 and a second rubber pad 52 is shown fixedly attached to an upper portion lower surface 59 in aligned relationship with each other for providing a non-abrasive means of clamping the snowboard 50. A stop 56 is shown formed at a first rubber pad inner end 69 and extending inwardly relative to the first rubber pad 55 for safely positioning the snowboard 50 within the first and second rubber pads 55 and 52.

In use, the position of the mounting frame 19 is first fixed by rotating the mounting frame 19 to the desired position and tightening the shaft nut 21 utilizing the first arm 22. If desired, the position retaining nut 24 can be tightened to the shaft nut 21 and the set screw 25 tightened as well. Next the snowboard 50 is positioned within the first rubber pad 55 and the second rubber pad 52 adjacent the stop 56. The snowboard 50 is then clamped in position by means of nut 41 which is tightened by means of second arm 42. If desired, a padlock can be inserted through the lock aperture 43 for added security.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A Snowboard Mounting Apparatus for mounting a snowboard or similar article to a supporting surface comprising:

a mounting frame;

a mounting plate having two ends and a raised section intermediate the ends, the mounting plate further comprising a plurality of bores formed therethrough for accepting a plurality of mounting screws, the raised section further comprising a threaded bore disposed therethrough for threadingly accepting a threaded first end of a shaft, the shaft having a threaded second end threadingly engageable to a threaded bore formed in the mounting frame;

at least one jaw having a lower portion fixedly attached to the mounting frame along a lower portion frame section, the jaw further comprising a means for hingedly attaching the lower portion to an upper portion such that the upper portion is rotatable relative to the lower portion, and a spring disposed around a bolt and between the lower portion and the upper portion, the bolt extending perpendicularly through a plurality of apertures formed in the mounting frame, lower portion frame section and the upper portion and having a threaded end for threadingly engaging a nut, the threaded end further comprising an aperture formed therethrough for receiving a padlock;

wherein the lower portion further comprises an angled section and a clamping section, the angled section being intermediate the lower portion frame section and the clamping section and extending downwardly from the lower portion frame section relative to the upper portion and terminating at the clamping section, the clamping section having a plane parallel to a plane of the lower portion frame section; and wherein the clamping section further comprises a first rubber pad fixedly attached to an inner surface and the upper portion further comprises a second rubber pad fixedly attached to a lower surface in aligned relationship with the first rubber pad.

2. The Snowboard Mounting Apparatus of claim 1, wherein the first rubber pad further comprises a stop integrally formed at an inner end, the stop extending inwardly relative to the first rubber pad.

3. The Snowboard Mounting Apparatus of claim 1, further comprising a first positioning plate fixedly attached to the shaft second end, the first positioning plate having a first plurality of teeth formed thereon for engaging a second plurality of teeth formed on a second positioning plate fixedly attached to the mounting frame and a shaft nut having a first arm integrally formed thereon for providing a means of hand tightening the shaft nut to the shaft second end.

4. The Snowboard Mounting Apparatus of claim 3, wherein the means for mounting the means for clamping the snowboard or similar article to the supporting surface further comprise a spring disposed between the first positioning plate and the second positioning plate.

5. The Snowboard Mounting Apparatus of claim 3, further comprising a position retaining nut threadingly engageable to the threaded second end for securing the shaft nut.

6. The Snowboard Mounting Apparatus of claim 1, wherein the nut further comprises a second arm integrally formed thereon, the second arm providing a means for hand tightening the nut.

* * * * *